United States Patent [19]

Harris

[11] 4,249,384

[45] Feb. 10, 1981

[54] ISOTHERMAL COMPRESSION-REGENERATIVE METHOD FOR OPERATING VAPOR CYCLE HEAT ENGINE

[76] Inventor: Marion K. Harris, P.O. Box 1591, Atascadero, Calif. 93422

[21] Appl. No.: 930,745

[22] Filed: Aug. 3, 1978

[51] Int. Cl.[3] ..... F01K 19/04

[52] U.S. Cl. ..... 60/670; 60/653; 60/654; 60/688

[58] Field of Search ..... 60/643, 645, 651, 653, 60/670, 671, 677, 654, 688

[56] References Cited

U.S. PATENT DOCUMENTS

| | | | |
|---|---|---|---|
| 3,568,444 | 6/1969 | Harris | 60/653 |
| 3,716,990 | 2/1973 | Davoud | 60/677 |
| 3,772,883 | 11/1973 | Davoud et al. | 60/653 |
| 3,798,908 | 3/1974 | Davoud et al. | 60/694 |

FOREIGN PATENT DOCUMENTS

| | | | |
|---|---|---|---|
| 570408 | 4/1924 | France | 60/688 |

*Primary Examiner*—Martin P. Schwadron
*Assistant Examiner*—Stephen F. Husar
*Attorney, Agent, or Firm*—Jack M. Wiseman

[57] ABSTRACT

A method of operation of a vapor cycle heat engine which includes the steps of regeneration, recompression, reheating and isothermal recompression with feedwater spray injection for improved cycle efficiency.

11 Claims, 3 Drawing Figures

PRESSURE-VOLUME DIAGRAM

TEMPERATURE-ENTROPY DIAGRAM

ISOTHERMAL COMPRESSION-REGENERATIVE METHOD FOR OPERATING VAPOR CYCLE HEAT ENGINE

BACKGROUND OF THE INVENTION

The present invention relates in general to vapor cycle piston heat engines, and more particularly to a method of operation of the vapor cycle of such an engine.

The present invention is useful for those heat engine applications requiring the highest practicable efficiency, notably portable applications for automobile power trains. Steam vapor cycle plants for automobile power trains enable a wide range of fuels to be employed with less atmospheric pollution than would result from internal combustion heat engine. It is projected that specific fuel costs and absolute fuel costs may be lower with such an engine than is presently the case for the internal combustion engine. To be successful in portable applications, the specific fuel consumption must be low. Accordingly, the engine itself must be made efficient and must be lightweight so as to keep the mass to be transported to a minimum.

In the patent to Marion K. Harris, U.S. Pat. No. 3,568,444, granted on Mar. 9, 1971, there is disclosed a method of operating a vapor cycle power plant, which includes the steps of regeneration, recompression and reheating to increase the net work output and efficiency.

The patent to John Gordon Davoud, U.S. Pat. No. 3,716,990, issued on Feb. 20, 1973, disclosed a condensable vapor power producing system in which a condensable fluid is heated to a predetermined temperature at a predetermined pressure and has a given entropy. Part of the steam is expanded in a work producing zone to a lower pressure and the condensed. The remaining part of the steam is expanded in a second zone. Water is then added to the expanded steam of the second zone to form a weight of steam greater than that introduced into the second zone, but at a lower entropy. The work of expansion in the second zone is used to compress the steam in the second zone.

The patent to John Gordon Davoud, U.S. Pat. No. 3,772,883, issued on Nov. 20, 1973, discloses an external combustion power producing cycle in which a condensable fluid is heated to a vapor state. The heated vapor is separated into two portions without changing the temperature, pressure, entropy, enthalpy, or specific volume state thereof. One portion is expanded isentropically in a first zone to a lower pressure in a non-compression, expansion-only cylinder and is removed from the cylinder and passed into a condenser. The other portion is expanded isentropically in a second zone in a series of expansion and compression cylinders. The weight equivalent of the one condensed portion of the fluid in liquid form of the first zone is introduced into the other portion of the fluid in the second zone. The mixture in the second zone is compressed isentropically to the maximum working pressure. The compressed fluid is reheated and re-expanded.

The patent to John Gordon Davoud, U.S. Pat. No. 3,798,908, issued on Mar. 26, 1974, discloses an external combustion power producing cycle in which condensable fluid is heated to a vapor state. The heated vapor is expanded isentropically. After expansion, the fluid is separated into two portions without changing the temperature, pressure, entropy, enthalpy, or its specific volume state. After the expanded fluid has been separated into two portions, one portion is condensed and the weight equivalent thereof is added, in liquid form, to the other portion of the expanded fluid. The mixture, which has a lower entropy than the fluid prior to the introduction of liquid, is compressed to the desired operating pressure.

SUMMARY OF THE INVENTION

Accordingly, it is an object of the present invention to provide a method of operating a steam vapor cycle power plan which is highly efficient.

It is another object of the present invention to provide a method of operating a steam vapor cycle power plant which has smooth, uniform power output.

It is yet another object of the present invention to provide a method of operating a steam vapor cycle power plant which employs injection of the liquid feedwater to provide an isothermal recompression step for improvement of cycle efficiency.

Briefly, the present invention accomplishes these and other objects by providing a vapor cycle operation for a vapor cycle piston heat engine which employs injection of a spray of condensed working substance so that an intermediate recompression step is isothermal, thus producing a higher cycle efficiency than is attainable with conventional vapor cycles. The cycle includes the steps of pumping, heating, expanding, isothermally recompressing followed by reheating, expanding, regeneratively cooling and condensing a working substance.

DESCRIPTION OF THE PREFERRED EMBODIMENT

Figure 1:
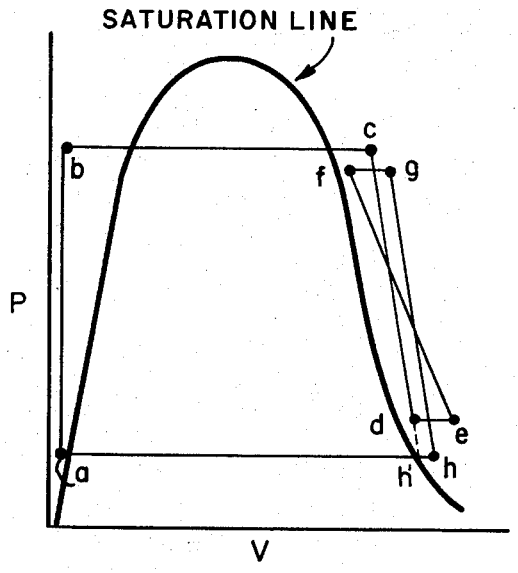
FIG. 1 is the theoretical pressure (P)—volume (V) diagram of the complete cycle of the present invention.
Figure 2:
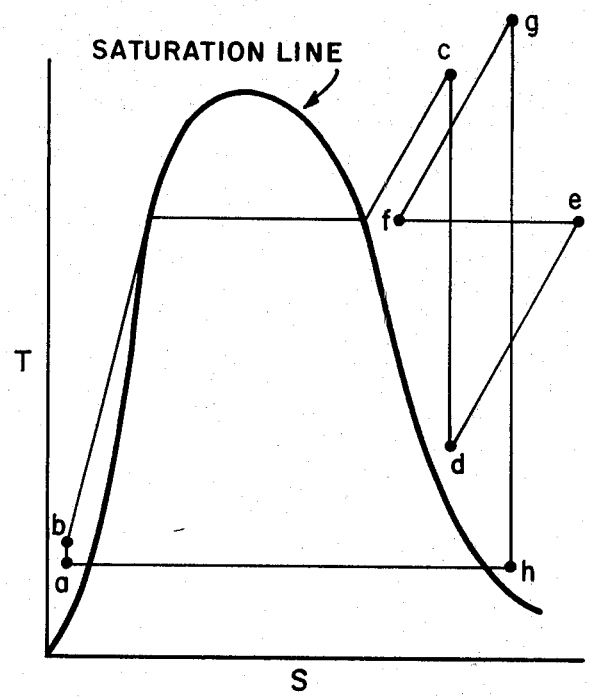
FIG. 2 is the theoretical temperature (T)—specific entropy (S) diagram of the complete cycle of the present invention.

Diagrammatic depictions of the theoretical vapor cycle in accordance with the present invention are shown in FIG. 1 and FIG. 2. FIG. 1 is the traditional diagram showing the inter-relationship of Pressure and Volume (P-V) of the working substance throughout the cycle, while FIG. 2 is a Temperature-Entropy (T-S) diagram showing the relationship between temperature and the available energy (Entropy) of the working substance.

As is well known, the area within the Pressure-Volume (P-V) diagram has units of work, while the area within the Temperature-Entropy (T-S) diagram has units of thermal energy. Thus, if the area of the diagram is increased due to modification of the cycle, modification of the engine, or the like, the increased area will be representative of increased work output from the engine. If maximum temperature, pressure and volume are held constant and differing theoretical cycles are employed, the cycle having the largest enclosed area on the cycle diagram will be representative of the highest overall efficiency.

In the following description, the steps involved in operating a heat engine in accordance with the present invention will first be described followed by description of an engine suitable for operating over the new cycle. Although other working substances are theoretically possible and may desirably be employed for particular applications, the most common working substance will be water vapor, or steam. The term "steam" therefore will be used interchangeably with "working substances" in this discussion.

THEORETICAL STEAM CYCLE

Referring now to FIGS. 1 and 2, the individual steps of the cycle will be described. In interpreting the diagram, it should be recognized that theoretically exact processes are employed for the sake of simplicity. In practice, of course, less exactness will be found due to the effects of clearance volume, wire drawing, cylinder condensation and the like in a practical engine. Nonetheless, a theoretically exact analysis will demonstrate the improvement in cycle efficiency which results from employment of the present cycle. Lower-case letters refer to the various steps as depicted on the diagram.

Feedwater is first pumped a-b to a high pressure followed by isobaric heating b-c causing steam initially to expand and the working substance to gain heat until a superheat condition is reached. The steam at point c is at approximately 1050° F. and 1200 psia. An adiabatic expansion step c-d produces an increase in volume with a decrease in temperature and pressure of the working substance resulting in work being extracted from the working substance. Should isobaric reheating d-e be employed, it could then bring the working substance to a higher temperature of 600° F. at 220 psia.

An isothermal compression e-f is then performed by injecting a small amount of feedwater into the working substance. Isothermal recompression improves the overall cycle efficiency, since it reduces the negative work of compression to a value below that for any usual polytropic process and below that for the ideal process which involves no gain or loss of energy (isentropic). Without spray injection, the (dry) recompression would involve a sharp increase in the temperature. Spray injection of cooler liquid water extracts heat. As the feedwater picks up heat of vaporization and changes state from the resulting mixture, it extracts and sequesters away heat from the contents of the compressor cylinder at the same rate at which work is being done on those contents by the piston. This results in constant temperature (isothermal) compression.

The working substance is for a second time isobarically reheated f-g bringing the working substance to 1000° F. at 1050 psia. A second adiabatic expansion g-h then follows bringing the working substance back to approximately its original pressure; producing an increase in volume and decrease in pressure and temperature; and resulting in further work being extracted from the working substance. The working substance may at this stage be exhausted through a heat exchanger in order to regeneratively increase the heat content of the input feedwater. The working substance is then exhausted, cooled and condensed h-a, leaving it at substantially the same state as at the beginning of the cycle at point a.

It is to be observed that reheating before compression is not required. However, a practical engine might advantageously include reheat ahead of, as well as following, the compressor cylinder.

Points c through h of the cycle are shown in the superheat region, outside of the saturation curve as is preferred. However, the possibility of operating the cycle with those points contained within the saturation curve does exist with only practical considerations dictating the choice of superheat operation. The area defined by lines d-e-f-g represents negative work.

Theoretical efficiencies calculated for the present cycle show that an appreciable efficiency improvement over conventional cycles results. Using a high temperature working substance having a temperature of 1050° F. at a pressure of 1200 psia before the first expansion, and having at exhaustion a temperature of 300° F. at 60 psia, a theoretical cycle efficiency of 27.9% may be calculated. An ideal steam consumption rate of 6.02 pounds per horsepower-hour is calculated. A higher overall efficiency and lower specific steam consumption rate than for conventional cycles is achieved.

Referring to the Pressure-Volume diagrams, an indication of the qualitative improvement in efficiency effected by the new cycle can be obtained by making an imaginary straight line from point c to point h', as though a conventional Rankine cycle were being discussed. State h' lies on the same pressure coordinate as point h, and is on an extension of the expansion line c-d. The area encompassed by the diagram to the right of such a line in FIG. 1 represents the increase in work which the cycle can produce without resort to higher, and perhaps unrealistic, working substance temperatures and pressures.

PISTON ENGINE OPERATION

Figure 3:
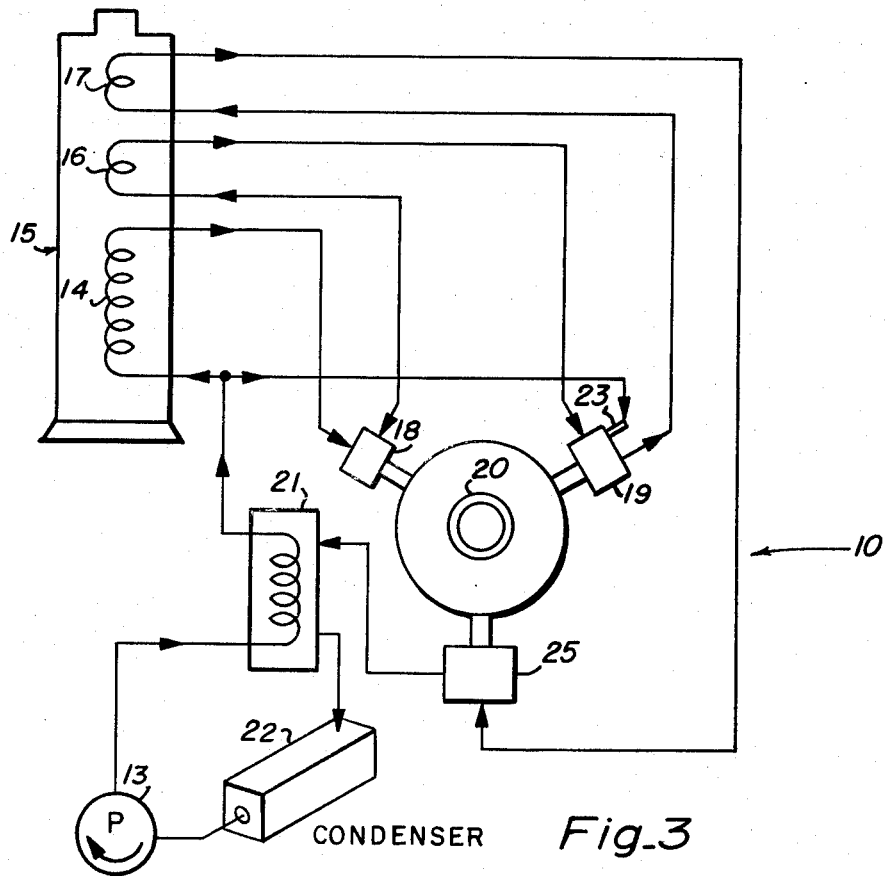
FIG. 3 is a schematic diagram of a two-stage steam piston engine power plant operating on the complete cycle of the present invention.

Referring now to FIG. 3, there is shown a schematic diagram of a piston engine 10 employing a steam vapor cycle in accordance with the present invention. A feedwater pump 13 pumps the feedwater at a high pressure state through an inlet coil 14 of a boiler 15 via a heat exchanger 21. In the boiler 15, heat is transferred to the water to produce steam. The boiler 15 employs additional coils 16 and 17 for the purpose of reheating the working substance in subsequent heating steps. Steam produced in the inlet coil 14 is first expanded in a high-pressure cylinder 18 resulting in useful work being produced at a crankshaft 20 of the engine 10.

Following this first expansion, steam is exhausted from the high-pressure cylinder 18 and re-enters the boiler 15 through the coil 16 where heat is again transferred into the working substance.

The reheated working substance is next introduced into the isothermal recompression cylinder 19 through the heating coil 16. The timing of the transfer is such that the working substance enters the cylinder 19 with the cylinder 19 at or near its optimum volume for the receipt of the working fluid. A piston within the cylinder 19 then compresses the working substance, a step which normally would result in a great increase in temperature. However, in the present invention, a small quantity of feedwater, already available under pressure from pump 13, is spray injected by injector 23 into the cylinder 19, causing a stabilization in temperature and causing the compression to take place isothermally.

Following compression, the working substance is again introduced into the boiler 15 through the coil 17 where further reheating takes place. Re-reheated steam is conducted into a low pressure cylinder 25 via the coil 17. Re-reheated working substance is then expanded for a second time in the low pressure cylinder 25 resulting in further useful work being imparted to the engine crankshaft 20. Regenerative heating may also be employed to further improve efficiency. Thus, the exhaust of the cylinder 25 is routed through a heat exchanger 21 where input feedwater is heated by exchange of heat energy from the exhausted working substance to the feedwater. As is well known, the difference in source and sink temperature determines the maximum efficiency of a heat engine, and lowering the sink temperature through means of the heat exchanger 21 both increases the difference in source and sink and adds otherwise wasted heat back into the working substance before the cycle begins anew. The low pressure cylinder 25 with a larger gross work output drives the recompression cylinder 19 with a net LP work balancing total HP work.

Condenser 22 receives the output of heat exchanger 21 and cools the vapor to return it to its original state for reuse as input feedwater. As noted above, it will be desirable to design an engine for use with the present cycle so that equal stroke lengths and equal net work outputs are employed for all cylinders in order to obtain smooth operation. The physical dimensions of such an engine must be chosen with those criteria in mind. Operation of such an engine will conform substantially to the performance described in the P-V and T-S diagrams.

Although it is not theoretically necessary to do so, it will be desirable to operate the cycle over temperature and pressure restrictions which will produce superheat in the working substance at all points in which the working substance is in contact with the engine in order to avoid cylinder condensation which adversely affects cycle efficiency and engine output. For this reason, even the exhaust should contain some superheat. Thus, points c through h should be chosen to fall to the right and above the saturation line as depicted.

In principle, it is possible to provide all of the required reheat in a single coil. It will usually be desirable, however, to provide two coils for reheating as shown, one preceding recompression and one following recompression, in order to provide a receiver for the working substance between adjacent cylinders. This arrangement allows some flexibility in selecting valve timing and relative phase of the adjacent cylinder, which flexibility will preferably be employed to produce an engine design which is balanced and produces even power pulses.

While a preferred version of the present invention has been described, it will be appreciated by those skilled in the art that variations in details may be practiced without departure being made from the teachings of this specification. For example, higher temperatures and pressure may be employed than those described as examples, and different engine configurations which embody the present invention over a portion of their operation may be practiced. Each of these variations is specifically contemplated and is included within the scope of the following claims.

I claim:

1. A method of operating a vapor cycle heat engine comprising the steps of:

(a) pumping a working substance into a boiler to raise the pressure of the substance to a predetermined value;

(b) heating the working substance in the boiler;

(c) expanding the working substance in a cylinder for driving a load;

(d) exhausting the working substance;

(e) recompressing the exhausted working substance in an isothermal recompression cylinder to a pressure below said predetermined value; and (f) injecting a spray of recondensed working substance into the isothermal recompression cylinder for controlling temperature and for providing isothermal compression.

2. A method as claimed in claim 1 wherein the working substance enters the isothermal recompression cylinder at the time the isothermal recompression cylinder is generally at optimum piston position to receive the working fluid.

3. The method as claimed in claim 2 and including the step of reheating in the boiler the working substance before recompressing the working substance.

4. The method as claimed in claim 1 wherein said injecting a spray of recondensed working substance into the isothermal recompression cylinder homogenizes the resulting mixture in said isothermal recompression cylinder in providing isothermal compression.

5. A method for operating a vapor cycle heat engine comprising the steps of:

(a) pumping a working substance having a first pressure-volume-temperature state to convert said working substance to a second-pressure-temperature state;

(b) heating the working substance to convert it to a vaporized third pressure-volume-temperature state;

(c) expanding the working substance from the third pressure-volume-temperature state during which expansion external work is realized and the pressure and temperature of the working substance are decreased;

(d) exhausting the working substance to a fifth pressure-volume-temperature state;

(e) recompressing the working substance while injecting a spray of a portion of condensed working substance for intermixing with the vaporized working substance to produce a sixth pressure-volume-temperature state with isothermal compression at which the pressure is less than the pressure at said second state;

(f) exhausting the working substance and reheating it to a seventh pressure-volume-temperature state; and (g) expanding the working substance from the seventh pressure-volume-temperature state to an eighth pressure-volume-temperature state during which expansion external work is realized and the pressure and temperature of the working substance decreased.

6. The method of claim 5 and further including the step of exhausting the working substance after the eighth pressure-volume-temperature state.

7. The method of claim 6 and further including the step of regeneratively heating the input working substance by the exhausted working substance of the eighth pressure-volume-temperature state.

8. The method of claim 5 and further including the step of condensing the working substance after the eighth pressure-volume-temperature state.

9. The method of claim 5 in which the first and second expansions are controlled to result in an equal amount of net work being produced by each expansion.

10. The method of claim 1 in which the intermixing of a portion of the working substance with the vaporized working substance by the spray injecting of a portion of condensed working substance so as to homogenize the condensed working substance with the vaporized working substance to produce the sixth pressure-volume-temperature state with isothermal compression.

11. The method of claim 5 and including the step of reheating the exhausted working substance to the fifth pressure-volume-temperature state.

* * * * *